US009334106B2

(12) United States Patent
Jordan

(10) Patent No.: US 9,334,106 B2
(45) Date of Patent: May 10, 2016

(54) INSULATING TANK COVER

(71) Applicant: Travis Jordan, Charlo, MT (US)

(72) Inventor: Travis Jordan, Charlo, MT (US)

( * ) Notice: Subject to any disclaimer, the term of this patent is extended or adjusted under 35 U.S.C. 154(b) by 0 days.

(21) Appl. No.: 14/449,996

(22) Filed: Aug. 1, 2014

(65) Prior Publication Data

US 2015/0076150 A1 Mar. 19, 2015

Related U.S. Application Data

(60) Provisional application No. 61/861,212, filed on Aug. 1, 2013.

(51) Int. Cl.

| | |
|---|---|
| ***B65D 88/34*** | (2006.01) |
| ***B65D 88/36*** | (2006.01) |
| ***B65D 88/50*** | (2006.01) |

(52) U.S. Cl.

CPC ..... *B65D 88/36* (2013.01); *B65D 88/34* (2013.01); *B65D 88/50* (2013.01)

(58) Field of Classification Search

CPC ..... B65D 88/34; B65D 88/36; B65D 88/50
USPC ..... 220/216–227; 52/591.1, 592.1, 536
See application file for complete search history.

(56) References Cited

U.S. PATENT DOCUMENTS

| | | | | | |
|---|---|---|---|---|---|
| 1,639,625 | A | * | 8/1927 | Afonin | 220/218 |
| 1,767,142 | A | * | 6/1930 | Kramer | 220/219 |
| 1,901,874 | A | * | 3/1933 | Horton | 220/221 |
| 2,919,047 | A | | 12/1959 | Fino | |
| 3,493,143 | A | * | 2/1970 | Thompson et al. | 220/218 |
| 3,910,452 | A | | 10/1975 | Szasz | |
| 4,018,356 | A | * | 4/1977 | Szasz et al. | 220/220 |
| 4,189,058 | A | | 2/1980 | Seliskar et al. | |
| 4,202,460 | A | * | 5/1980 | Imbeault | 220/218 |
| 4,213,280 | A | * | 7/1980 | Sandborn | 52/309.9 |
| 4,270,232 | A | | 6/1981 | Ballew | |
| 4,749,606 | A | | 6/1988 | Moore | |
| 5,188,550 | A | | 2/1993 | Oliver | |
| 6,193,092 | B1 | | 2/2001 | Witter | |
| 6,922,956 | B2 | | 8/2005 | Johnson et al. | |
| 7,240,804 | B2 | | 7/2007 | King et al. | |
| 8,029,208 | B1 | | 10/2011 | Lee et al. | |
| 8,221,030 | B1 | | 7/2012 | Haydu | |

(Continued)

FOREIGN PATENT DOCUMENTS

WO WO2012049502 4/2012

OTHER PUBLICATIONS

Industrial and Environmental Concepts, Custom Floating Tank Covers, http://www.ieccovers.com/tankCovers.php.

(Continued)

*Primary Examiner* — Fenn Mathew
*Assistant Examiner* — James N Smalley
(74) *Attorney, Agent, or Firm* — Shaver & Swanson, LLP; Robert L. Shaver

(57) ABSTRACT

An insulative cover for large tanks containing a fluid. The insulative cover utilizes rectangular panels to cover a majority of the fluid surface and trapezoidal or wedge shaped panels to form a ring around the rectangular panels. Each panel utilizes a locking rim to allow the panels to interlock when installed. In this way the rectangular panels cover the main surface but leaves spaces where the rectangular panels do not match with the curvature of the tank. These spaces are covered by the trapezoidal panels.

9 Claims, 5 Drawing Sheets

(56) References Cited

U.S. PATENT DOCUMENTS

| | | | | |
|---|---|---|---|---|
| 8,342,352 | B2 | 1/2013 | Alirol | |
| 2007/0023432 | A1 | 2/2007 | Seow | |
| 2010/0293877 | A1* | 11/2010 | Harris et al. | 52/302.1 |
| 2013/0036980 | A1 | 2/2013 | Reusche et al. | |
| 2013/0121766 | A1 | 5/2013 | Birger | |

OTHER PUBLICATIONS

Advanced Water Treatment Technologies, AWTT Floating covers,http://awtti.com/.

Advanced Water Treatment Technologies, Armor Ball Floating Cover, http://awtti.com/armor_balls_cover.php.

Advanced Water Treatment Technologies, Hexprotect Floating Cover, http://awtti.com/hexprotect_cover.php.

BTL, BTL Liners Oil, Gas, & Mining Applications, http://www.btlliners.com/applications/oil-gas-mining/.

ETP Environmental Products, ETP Tank Covers—Floating Covers, http://www.etpinfo.com/floatcov.htm.

Benchmark Foam Inc., Interlocking Tank Pads for Above Ground Storage Tank Support, http://benchmarkfoam.com/products/interlocking-tank-pads-for-above-ground-storage-tank-support/.

* cited by examiner

INSULATING TANK COVER

PRIORITY/CROSS-REFERENCE TO RELATED APPLICATIONS

This Application claims priority to U.S. Patent Application No. 61/861,212, which is herein incorporated by reference.

TECHNICAL FIELD

The presently disclosed and claimed inventive concepts generally relate to storage tanks, and more particularly to a floating insulative cover.

BACKGROUND OF THE INVENTION

Hydraulic fracturing, "frac'ing," has become increasingly prevalent as the search and demand for additional fossil fuel sources expands. Frac'ing is the fracturing of underground rock through the use of pressurized liquids. In order to release underground fossil fuels high-pressure fluid, often water mixed with sand and chemicals, is injected into a wellbore to create small fractures in the rock. These fractures allow natural gas, petroleum, and brine to travel to the well and be harvested.

Frac'ing has become popular due to economic benefits. Through the use of frac'ing, wells are able to produce an increased amount of fossil fuels. This allows additional production without necessitating additional drilling operations, additional derricks or additional platforms.

The process of frac'ing requires large volumes of fluid, such as water, be available to pressurize the wellbore that extends 20,000 feet beneath the surface of the earth. This fluid is typically stored in large above ground tanks. These tanks are often left uncovered with the fluid within the tank exposed to the environment. The tanks are often at temperatures exceeding 90° F. The open top design results in significant loss of fluid through evaporation and also allows for contamination such as birds falling into the tank.

SUMMARY OF THE DISCLOSURE

Disclosed is an insulation system for covering the surface of a liquid in a tank. The system utilizes rectangular panels which have a top and a bottom side as well as a first, second, third and fourth sides that define the perimeter of the top and bottom sides. The first, second, third and fourth sides have a locking rim which is spaced apart from the edge of the top or bottom side. The locking rim engages with locking rims on adjacent panels. In this manner the panels are locked together horizontally to prevent gaps forming in the insulation cover.

The tanks used to hold the liquid are generally circular in shape. The use of rectangular panels to cover the surface of the fluid results in spaces being created where the rectangular panels do not match the circular edge of the tank. In order to cover the spaces the insulation system utilizes circumferential panels that have an upper and lower side and an inside and outside edge, and a left and right edge. The inside edge is shorter than the outside edge resulting in the left and right edges not being parallel with each other. The circumferential panels' left edge and right edge have locking room similar to that of the rectangular panels. During installation the circumferential panels are oriented so that the inside edge is toward the center of the tank. This allows the circumferential panels to lock together to form a ring extending around the edge of the tank. Further the outside edge of the circumferential panels can be curved in order to match the curvature of the tank.

The panels are designed to float on the surface of the liquid rather than being attached to the tank. In order to provide a floating and insulating panel, the panels can be made of various materials. In one embodiment the panels are made of foam and are further covered in a hard plastic cover. This hard plastic cover can be molded to include the locking rims that lock the panels together. The locking rims on rectangular panels can be done in several ways. One way is to have two adjacent locking rims oriented in one direction with the other two locking rims oriented in the opposite direction. In this way the panels will all have the same side up when installed adjacent to each other. The upward locking rims of one panel mate with the downward locking rim of an adjacent panel. Alternatively all of the panels can be manufactured to have locking rims facing the same direction. In this embodiment, adjacent panels will be facing in opposite directions. Additionally various sizes and thicknesses of panels can be used with a preferred embodiment being a panel with between one and two inches of foam covering the hard plastic shell.

The purpose of the Summary of the Invention is to enable the public, and especially the scientists, engineers, and practitioners in the art who are not familiar with patent or legal terms or phraseology, to determine quickly from a cursory inspection, the nature and essence of the technical disclosure of the application. The Summary of the Invention is neither intended to define the invention of the application, which is measured by the claims, nor is it intended to be limiting as to the scope of the invention in any way.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the descriptions of the preferred embodiments are to be regarded as illustrative in nature, and not as restrictive in nature.

DETAILED DESCRIPTION OF THE PREFERRED EMBODIMENTS

Figure 1:
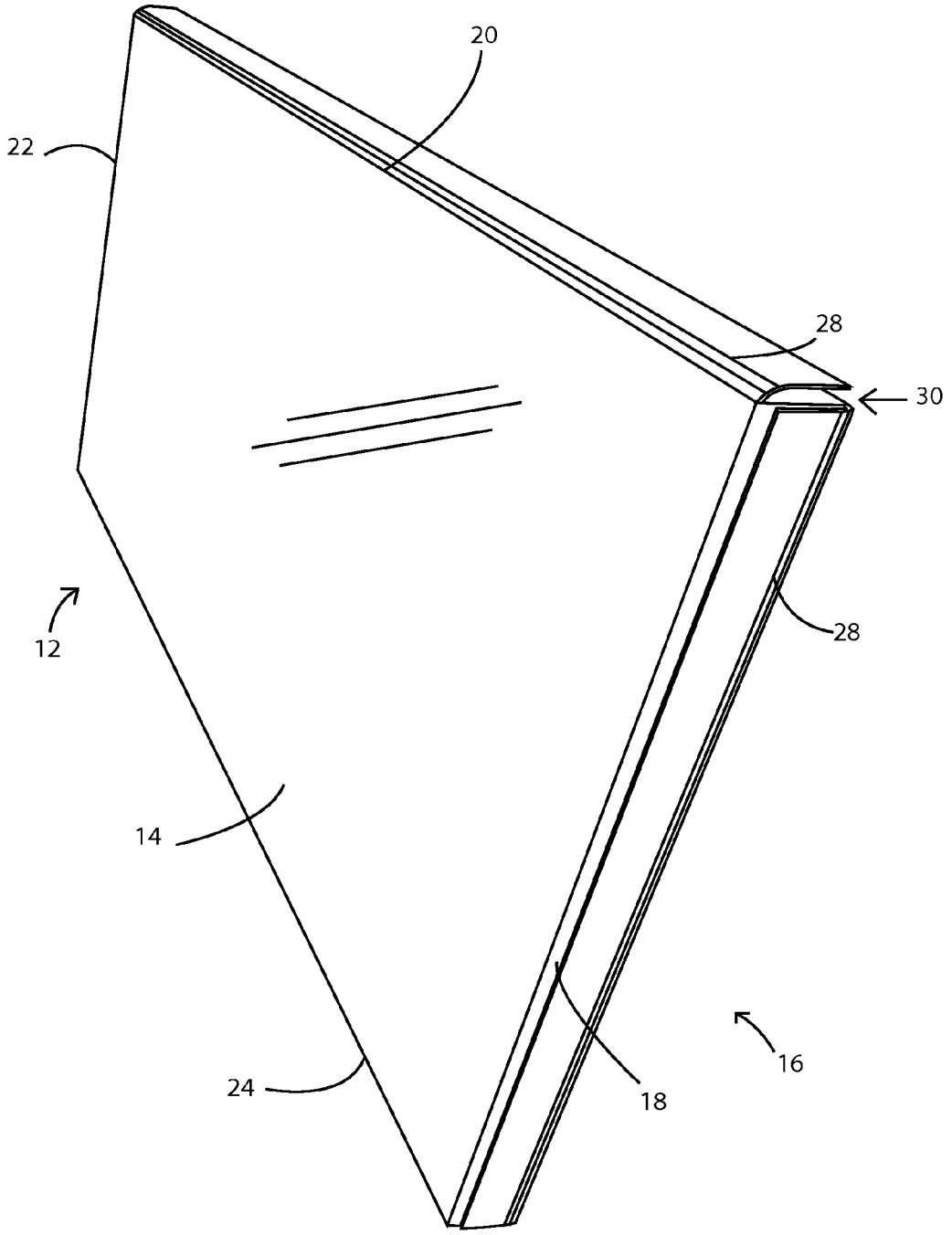
FIG. 1 is a perspective view of an insulative panel in accordance with an embodiment of the inventive concepts.
Figure 2:
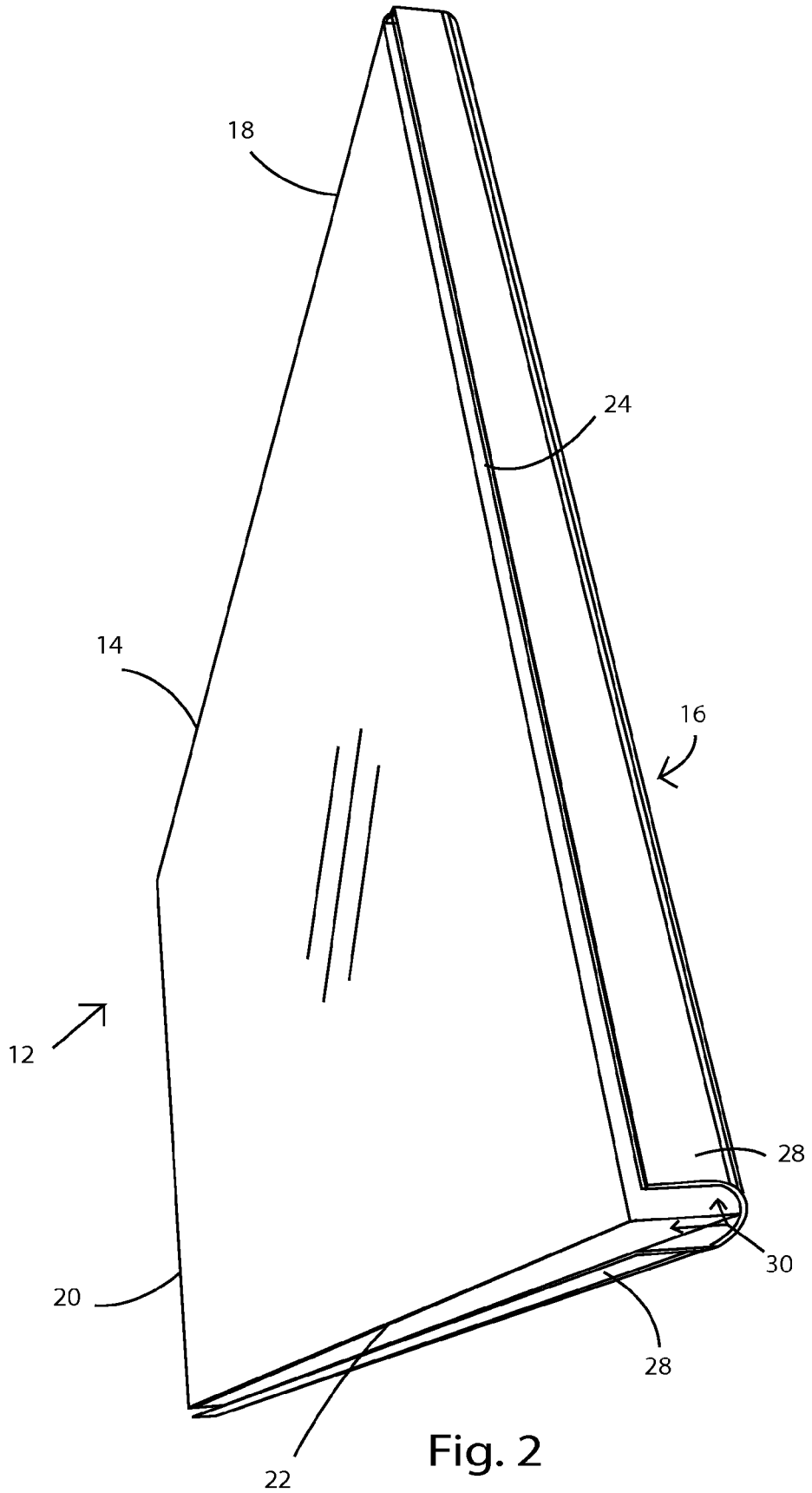
FIG. 2 is a perspective view of an insulative panel in accordance with an embodiment of the inventive concepts.

FIGS. 1-5 illustrate an insulation system for covering liquid in a tank. The insulation system utilizes a series of panels. The first panels used are of rectangular panels 12. Rectangular panel 12 is illustrated by FIG. 1 and FIG. 2. The rectangular panels 12 have a top side 14 and a bottom side 16. When installed, top side 14 faces upward while the bottom side 16 rests on top of the liquid surface. Top side 14 and bottom side 16 are defined by perimeter 26 that is defined by first side 18, second side 20, third side 22 and fourth side 24. It is preferable that the panel be rectangular in shape but other polygonal shapes can be utilized. In one embodiment top side 14 can be coated with a reflective material to further enhance the thermodynamic properties of the insulative cover.

The rectangular panel 12 can be made out of various materials that allow the panel to float on the liquid surface while providing insulative properties. A preferable material is foam. The use of foam results in rectangular panels 12 being light weight and low density allowing for flotation as well as providing insulation. The panel can include a hard plastic cover molded around a core that could be many materials such as foam. The hard plastic cover provides for protection during transport as well as prevents the core material from absorbing any liquid. It would also be possible to replace the foam with other insulative and low density material. Examples of this would be to have the panel hollow or inflatable to provide for an air space within the panel.

First side 18, second side 20, third side 22 and fourth side 24 each have a locking rim 28 extending away from the panel. Locking rim 28 creates a locking channel 30 allowing for the panels to be interlocked with adjacent panels having similar locking rims 28 and locking channels 30. In the embodiment shown in FIG. 1 and FIG. 2, the locking rims 28 on two adjacent sides are oriented in the same direction. This means that two adjacent locking rims 28 would be oriented downward. Meanwhile, the other two sides would have locking rims 28 oriented in the opposite direction. This results in a locking channel 30 that would interlock with a locking channel 30 of an adjacent panel 12 oriented in the same direction. In this manner each panel can be laid in the same orientation and still result in a floating insulative cover that does not drift apart and form gaps that can defeat the insulative properties of the panel. As an alternative, all of the locking rims 28 can be oriented in the same direction with respect to top side 14 and bottom side 16. In this embodiment the adjacent panels are reversed such that the top side of first panel is exposed to sunlight while the bottom side of all adjacent panels is exposed to the sunlight. While different sizes can be used, a typical size would be a panel that is 2" of foam, ⅛" HDPE plastic laminated to the top and bottom of the foam, and cut into 4'×8' sheets. The plastic can be bent on the edges to form the locking rim 28 or the locking rim 28 can be molded on during manufacturing.

Figure 3:
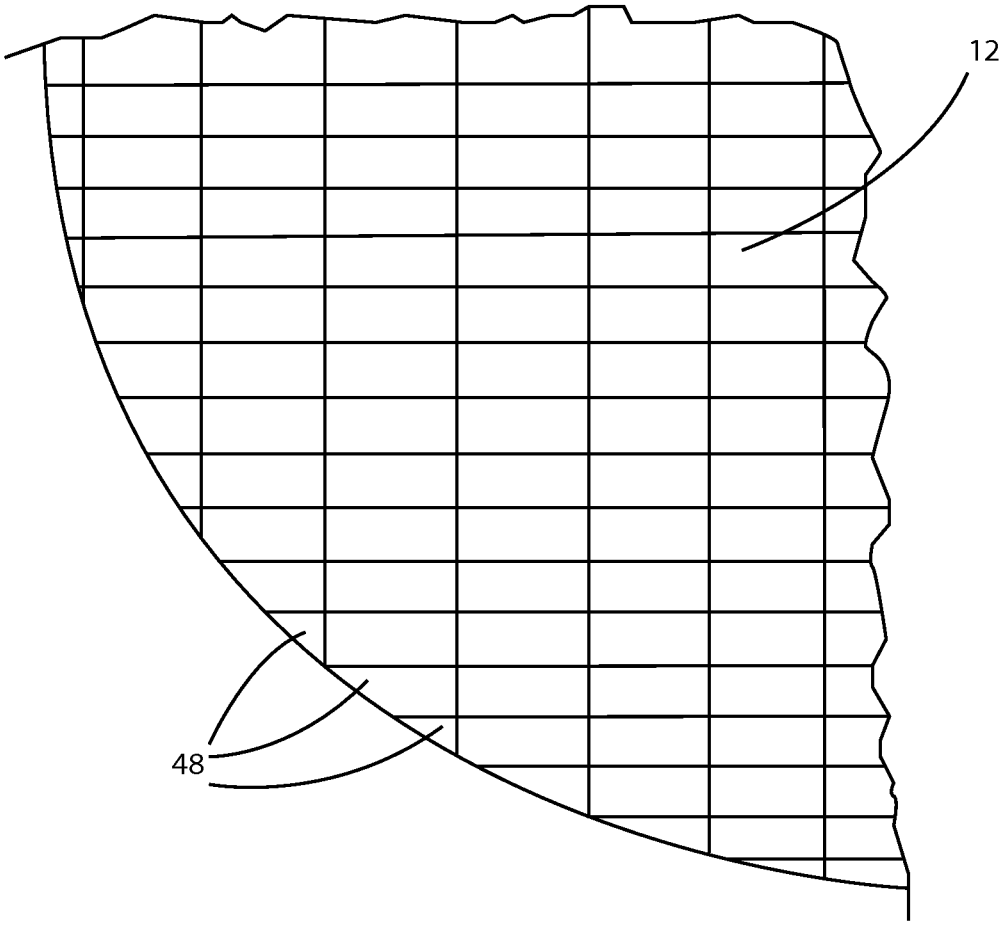
FIG. 3 is a view from above a section of the tank prior to complete installation of the insulative system.
Figure 4:
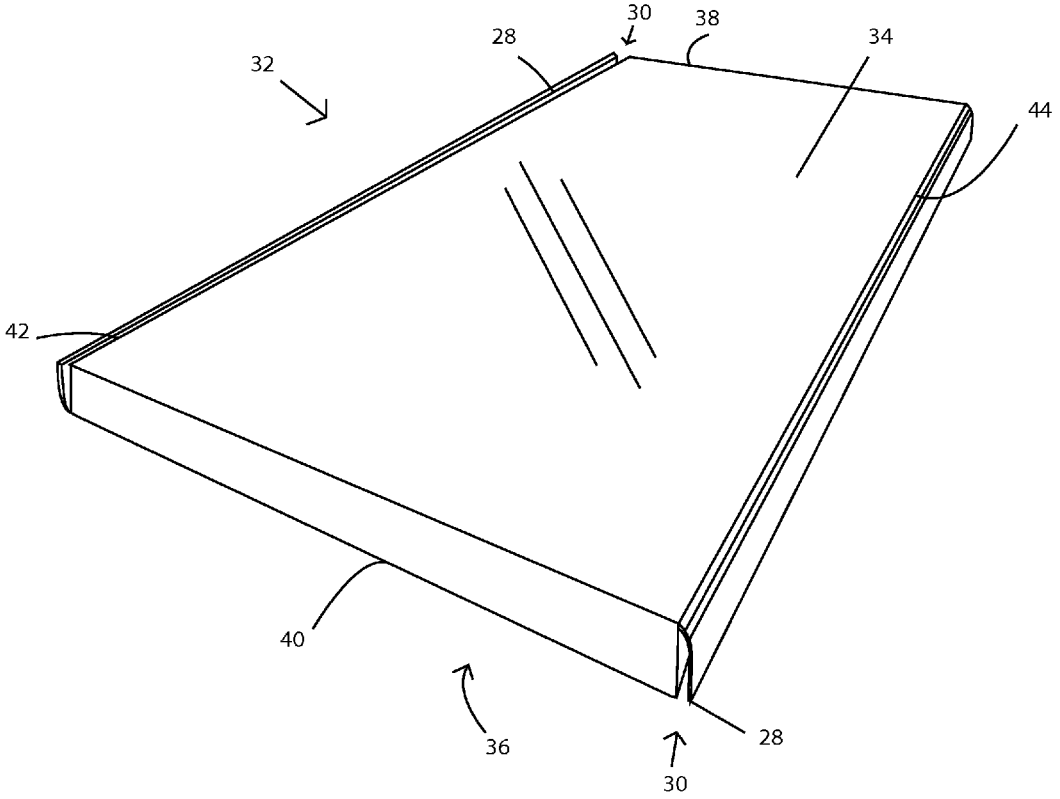
FIG. 4 is a perspective view of an insulative panel in accordance with an embodiment of the inventive concepts.

As shown in FIG. 3, the use of the rectangular panels 12 results in spaces 48 being created near the edge of the tank. These spaces are caused by the insulation panels not perfectly aligning with the curvature of the tank. In order to cover the spaces 48, circumferential panels 32, shown in FIG. 4, are utilized. The circumferential panels 32 have an upper side 34, a lower side 36, an inside edge 38, an outside edge 40, a left edge 42 and a right edge 44. The circumferential panels 32 are located near the edge of the tank and float on top of the rectangular panels 12 that have already been installed. The inside edge 38 is positioned toward the center of the tank while the outside edge 40 is positioned near or on the edge of the tank. Left edge 42 and right edge 44 of circumferential panels 32 have locking rim 28. The locking rim 28 of circumferential panels 32 can be designed similar to the locking rim 28 used on the rectangular panels 12. The locking rim 28 of circumferential panels 32 also defines a locking channel 30 which allows one circumferential panel 32 to become engaged with an adjacent circumferential panel 32. This prevents the circumferential panels 32 from moving apart and allowing for gaps in the insulative cover. In one embodiment the locking rims 28 on a circumferential panel 32 are in opposing directions. In this way, each circumferential panel 32 is placed so that the upper side 34 is facing the sun while the lower side 36 is facing downward the tank. It is also foreseeable that the locking rims 28 will be oriented in the same direction so that on one circumferential panel 32 the upper side 34 is facing the sun while adjacent circumferential panels 32 are placed with the upper side 34 facing into the tank. In creating the rectangular panels 12 and circumferential 32, the locking rim 28 can be formed as a molded part of the plastic cover.

In order to accommodate the circular path of the tank wall, inside edge 38 is shorter than outside edge 40. The shorter length of inside edge 38 compared to the length of outside edge 40 creates a trapezoidal shape for the circumferential panels 32. When installed, this creates a curving shape that is designed to mimic the curvature of the tank. In one embodiment, outside edge 40 can be curved in order to more specifically align with the edge of the tank.

Figure 5:
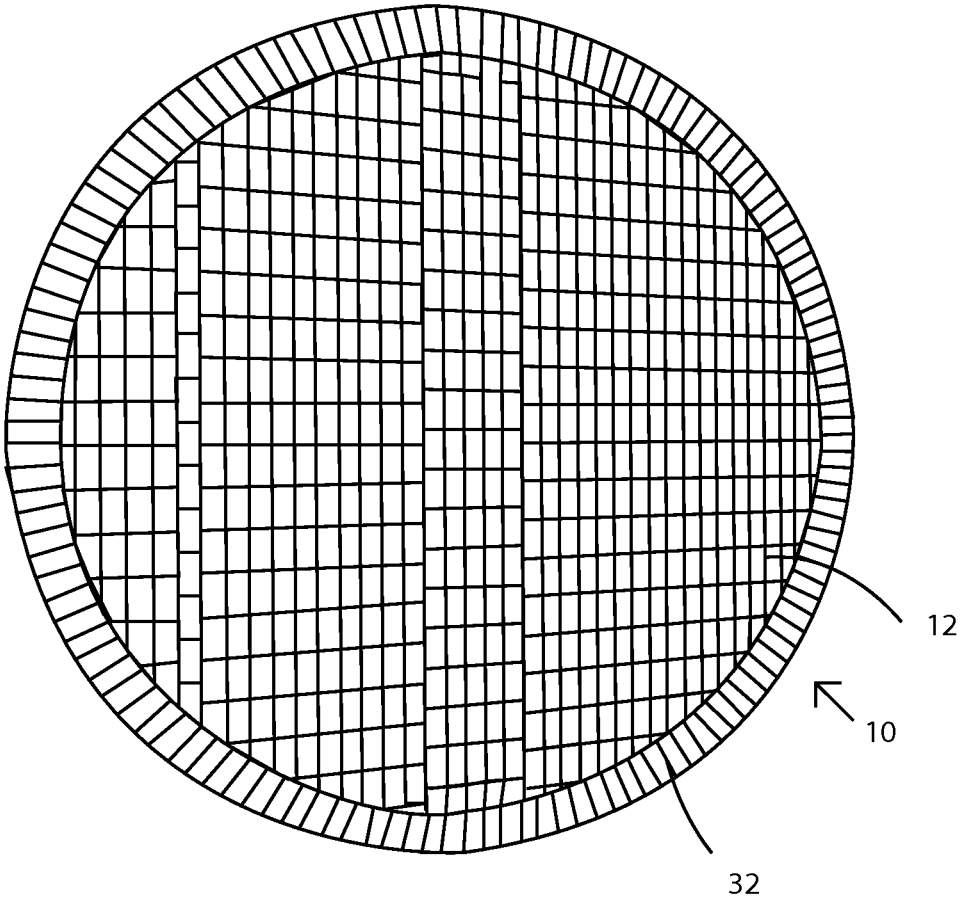
FIG. 5 view from above a tank incorporating an insulative panel cover in accordance with an embodiment of the inventive concepts.

FIG. 5 shows a fully installed insulation system 10. FIG. 5 shows the rectangular panels 12 having interlocked with each other and circumferential panels 32 also interlocked to form a ring around the edge of the tank. The rectangular panels 12 float on top of the liquid within the tank while the circumferential panels 32 rest on top of the rectangular panels 12. Circumferential panels 32 do not require fasteners to hold in place but are preferably held in place by friction with the rectangular panels 12. FIG. 3 shows a section of tank with the rectangular panels 12 installed. Near the edge of the tank, due to the curvature of the tank wall, spaces 48 are created. These spaces circumferential panels 32 are designed to cover and insulate.

I claim:

1. A tank and insulation system for covering a liquid in said tank, comprising a plurality of rectangular panels, with each panel having a top and bottom side, a first, second, third and fourth sides defining the perimeter of said top and bottom sides, said first, second, third and fourth sides having a locking rim which is spaced apart from said panel sides and defines a locking channel for engagement with said locking rim on adjacent panels;

a plurality of circumferential panels, having an upper and lower side, an inside and outside edge, and a left and right edge, said inside edge being shorter than said outside edge so that said left edge and said right edge are not parallel to each other, said left and right edges having a locking rim spaced apart from said left and right side edges, said locking rims on said left and right side edges configured for engagement with said locking rims on adjacent circumferential panels;

said plurality of rectangular panels configured to lock together when floating on a surface of a liquid, said plurality of rectangular panels creating a plurality of spaces defined by an edge of the tank, one of said sides of one rectangular panel and one of said sides of a second rectangular panel;

said plurality of said circumferential panels configured to lock together to form a ring covering said plurality of spaces.

2. The insulation system of claim 1 in which said panels are made of foam.

3. The insulation system of claim 2 wherein said panels are bounded by a hard plastic cover.

4. The insulation system of claim 3 wherein said locking rims are made of a hard plastic and molded onto said hard plastic cover.

5. The insulation system of claim 1 in which said outside edge of said circumferential panels has a curve to match a curve on the inside of the tank.

6. The insulation system of claim 1 in which said top side of said rectangular panels and said upper side of said circumferential panels are covered with a reflective material.

7. The insulation system of claim 1 in which two adjacent of said locking rims of said rectangular panels are attached to the bottom side and the remaining two of said locking rims are attached to the top side.

8. The insulation system of claim 1 in which said circumferential panels rest on top of portions of said rectangular panels.

9. The insulation system of claim 1 wherein said rectangular panels are made with between 1 and 2 inches of foam and covered in a hard plastic shell.

* * * * *